US006553604B1

(12) United States Patent
Braun et al.

(10) Patent No.: US 6,553,604 B1
(45) Date of Patent: Apr. 29, 2003

(54) TOOTHBRUSH

(75) Inventors: Phillip M. Braun, Exeter, RI (US); William Alan Bredall, Pacifica, CA (US); Karen Lynn Claire, Somerville, MA (US); Thomas Craig Masterman, San Francisco, CA (US); Mark Edward McConnell, Foster City, CA (US); Michael F. Roberts, Braintree, MA (US); Thomas Overthun, San Francisco, CA (US)

(73) Assignee: Gillette Canada Company, Halifax (CA)

( * ) Notice: Subject to any disclaimer, the term of this patent is extended or adjusted under 35 U.S.C. 154(b) by 0 days.

(21) Appl. No.: 09/526,679

(22) Filed: Mar. 16, 2000

(51) Int. Cl.[7] ..... A46B 9/04; A46B 7/06
(52) U.S. Cl. ..... 15/167.1; 15/201
(58) Field of Search ..... 15/167.1, 201, 15/186

(56) References Cited

U.S. PATENT DOCUMENTS

| | | | | |
|---|---|---|---|---|
| 2,263,802 | A | | 11/1941 | Grusin |
| 2,486,847 | A | | 11/1949 | Hokett |
| 2,604,649 | A | | 7/1952 | Stephenson et al. |
| 2,637,870 | A | * | 5/1953 | Cohen |
| 2,882,544 | A | * | 4/1959 | Hadidian |
| 2,935,755 | A | * | 5/1960 | Leira |
| 3,110,918 | A | | 11/1963 | Tate |
| 3,129,449 | A | * | 4/1964 | Cyzer |
| 4,114,222 | A | | 9/1978 | Serediuk |
| 4,633,542 | A | | 1/1987 | Taravel |
| 4,694,844 | A | | 9/1987 | Berl et al. |
| 4,776,054 | A | | 10/1988 | Rauch |
| 5,269,038 | A | | 12/1993 | Bradley |
| 5,357,644 | A | | 10/1994 | Theriault |
| 5,398,366 | A | | 3/1995 | Bradley |
| 5,435,032 | A | | 7/1995 | McDougall |
| 5,528,786 | A | | 6/1996 | Porat et al. |
| 5,799,354 | A | * | 9/1998 | Amir |
| 5,802,656 | A | | 9/1998 | Dawson et al. |
| 5,813,079 | A | | 9/1998 | Halm |
| 5,839,148 | A | | 11/1998 | Volpenhein |
| 5,896,614 | A | | 4/1999 | Flewitt |
| 5,991,959 | A | | 11/1999 | Raven et al. |

FOREIGN PATENT DOCUMENTS

| | | |
|---|---|---|
| DE | 1 210 409 | 2/1966 |
| DE | 003928919 A | 3/1991 |
| DE | 19817704 | 4/1998 |
| EP | 0 857 026 B1 | 1/2000 |
| EP | 0 972 464 A1 | 1/2000 |
| JP | 405076416 A | 3/1993 |
| RU | SU 1752336 A1 | 5/1990 |
| WO | WO 99/37181 | 7/1999 |

* cited by examiner

*Primary Examiner*—Randall E. Chin
(74) *Attorney, Agent, or Firm*—David A. Howley

(57) ABSTRACT

A toothbrush includes a handle, a head extending from the handle, and a plurality of tooth cleaning elements, such as tufts of bristles, extending from the head. Each tooth cleaning element is supported for rotation about primarily only one axis. Each tooth cleaning element is rotatable independent of the other tooth cleaning element(s).

11 Claims, 4 Drawing Sheets

TOOTHBRUSH

FIELD OF THE INVENTION

The invention relates generally to the field of oral care, and in particular to toothbrushes.

BACKGROUND OF THE INVENTION

A Japanese patent document having an application number of 3-312978 discloses a toothbrush having a multiplicity of tufts of nylon bristles. In a first embodiment shown in FIGS. 1, 2 and 3, a plurality of cylindrical recessed sections in the head are set orthogonally to the longitudinal axial direction of a shank and are formed at equal intervals. Column-shaped rotary bodies 5 are respectively contained in the recessed sections. On the peripheral surfaces of the rotary bodies 5, along the axial direction, projected strip sections 5*a* are formed, and they are set in a state that they are positioned at the opening sections of the recessed sections. At the opening sections of the recessed sections, contact surfaces to be positioned on both the sides are formed. At both the ends of the upper surfaces of the projected strip sections 5*a,* nylon bristles 6 are arranged to be vertically erected.

As shown in FIG. 3, the arrangement described above allows bristles 6 to rotate during use of the brush. A problem with this brush is that two tufts of bristles are secured to each strip section 5*a* and thus must rotate in unison. As a result, an individual tuft of bristles cannot rotate independently of its "partner" tuft. The individual tuft may thus be prevented from achieving optimal penetration between two teeth during brushing because the partner tuft might contact the teeth in a different manner and interfere with rotation of the individual tuft.

FIGS. 4, 5 and 6 disclose a second embodiment in which each tuft of bristles is secured to the head by a ball and socket type arrangement. While this embodiment allows each tuft of bristles to swivel independent of the other tufts, it does have disadvantages. If a tuft of bristles is tilted out towards the side of the head and that tuft is positioned near the interface between the side and top surfaces of the teeth, chances are increased that the bristle tips will not even be in contact with the teeth during brushing. Further, random orientation in which the tufts can end up after brushing detracts from the attractiveness of the brush.

SUMMARY OF THE INVENTION

The present invention is directed to overcoming one or more of the problems set forth above. Briefly summarized, according to one aspect of the present invention, a toothbrush includes a handle, a head extending from the handle, and a plurality of tooth cleaning elements, such as tufts of bristles, extending from the head. Each tooth cleaning element is supported for rotation about primarily only one axis. Each tooth cleaning element is rotatable independent of the other tooth cleaning element(s).

By having each tooth cleaning element supported for rotation about only one axis, the problems mentioned above for the ball and socket tuft support are avoided. That is, the chances are increased that the tooth cleaning element will remain in contact with teeth during brushing and the brush will be more attractive in appearance.

Further, as each tooth cleaning element is rotatable independent of the other tooth cleaning element(s), the problem discussed above with the first Japanese embodiment is avoided. Each tooth cleaning element can achieve optimal interdental penetration without interference from rotation by another tooth cleaning element.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
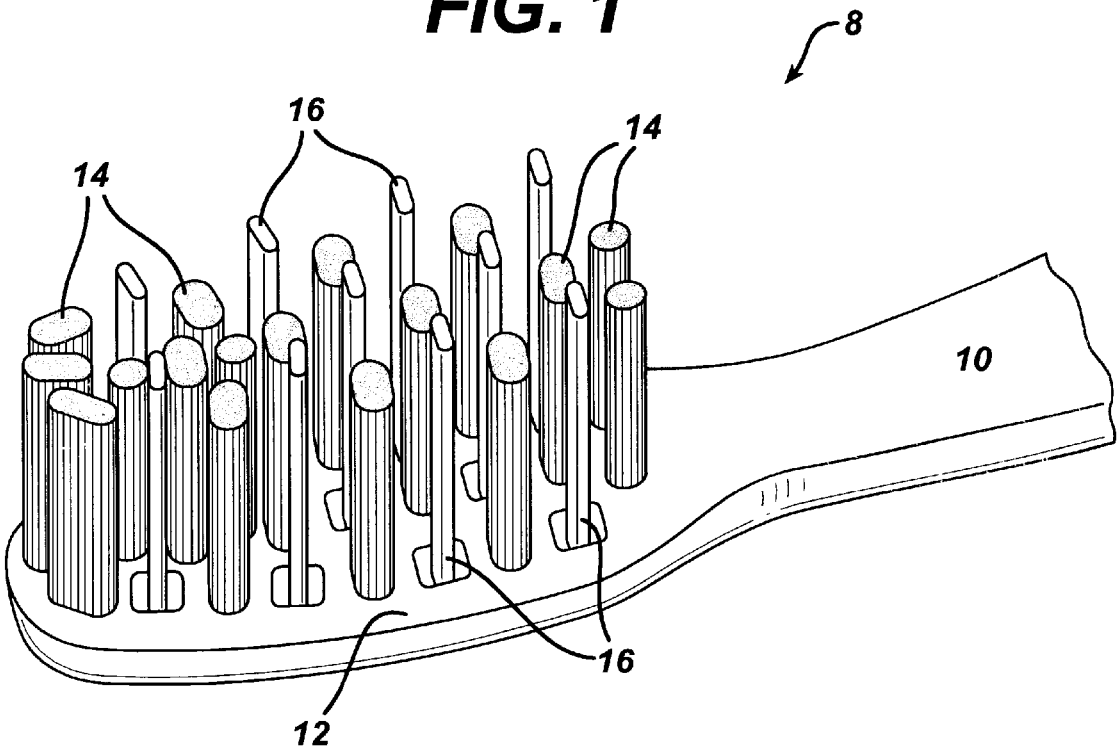
FIG. 1 is a perspective view of a toothbrush according to a first embodiment of the invention.

Beginning with FIG. 1, a toothbrush 8 includes a handle 10 from which extends a head 12. Head 12 includes a first group of tooth cleaning elements 14, such as tufts of bristles, which are secured to the head in a conventional manner (e.g. by stapling or hot-tufting). Elements 14 are designed to clean the exposed surfaces of teeth.

A second group of tooth cleaning elements 16 are secured to head 12 such that each element can independently rotate about a single axis during use of the brush. Each elements 16 can be a tuft of bristles or, alternatively, a single unitary fin made of plastic or rubber. Elements 16 are designed to penetrate in between teeth to clean the interdental spaces.

The interproximal residence time of elements 16 is significantly increased as compared to elements 14 which are rigidly fixed to head 12. An experiment was conducted in which the interproximal residence time was determined for fixed tufts at both a 0 degree (like element 14) and 16 degree forward angle, and for rotating tufts such as element 16. The tufts had an average of 40 bristles each with each bristle having a 7-mil diameter. Residence times were measured on a Single Filament Tester (SFT) with a load of 4 g/tuft at velocities between 0.5 and 10 in/s.

Figure 6:
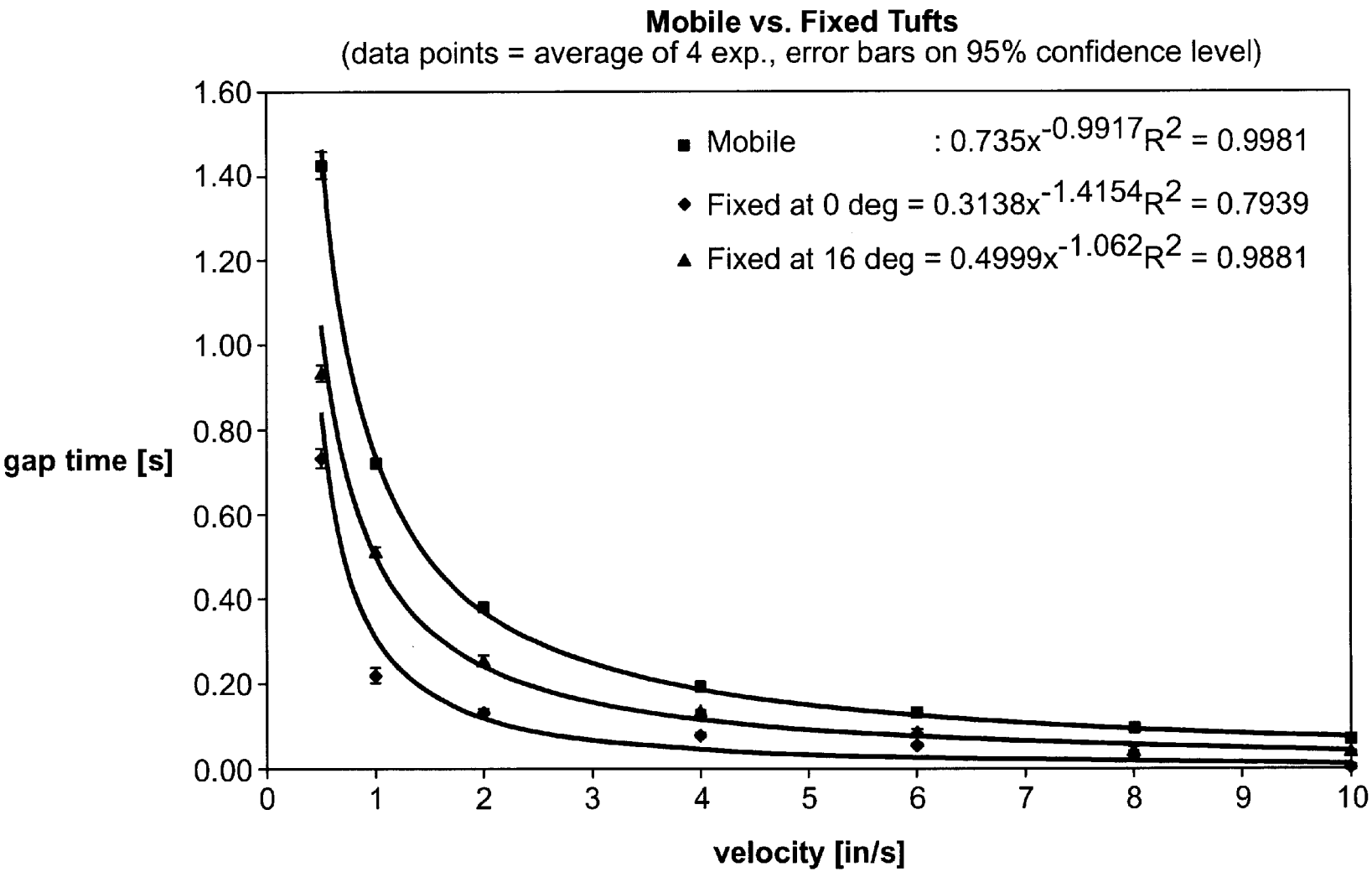
FIG. 6 is a graph showing interproximal residence time of mobile tufts and fixed tufts in the interdental gap(s).

The graph of FIG. 6 shows interproximal residence time of mobile tufts and fixed tufts in the interdental gap(s). The data are averages over 4 experiments. The error bars represent the error of the mean at the 95% confidence level. This experimental data shows that rotating tufts experience 1.6 times more interproximal residence time compared to angled fixed bristle tufts, and 2.7 times more interproximal residence time compared to vertical fixed bristle tufts. More interproximal residence time translates into better cleaning between teeth .

Figure 3:
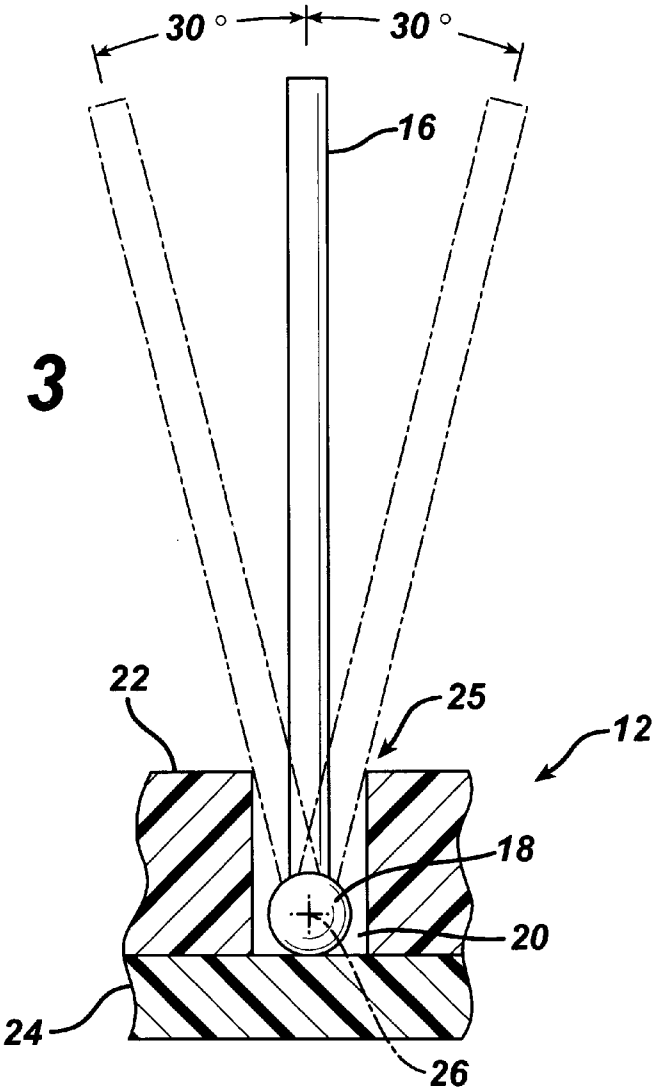
FIG. 3 is a sectional view taken along the lines 3—3 of FIG. 2.
Figure 2:
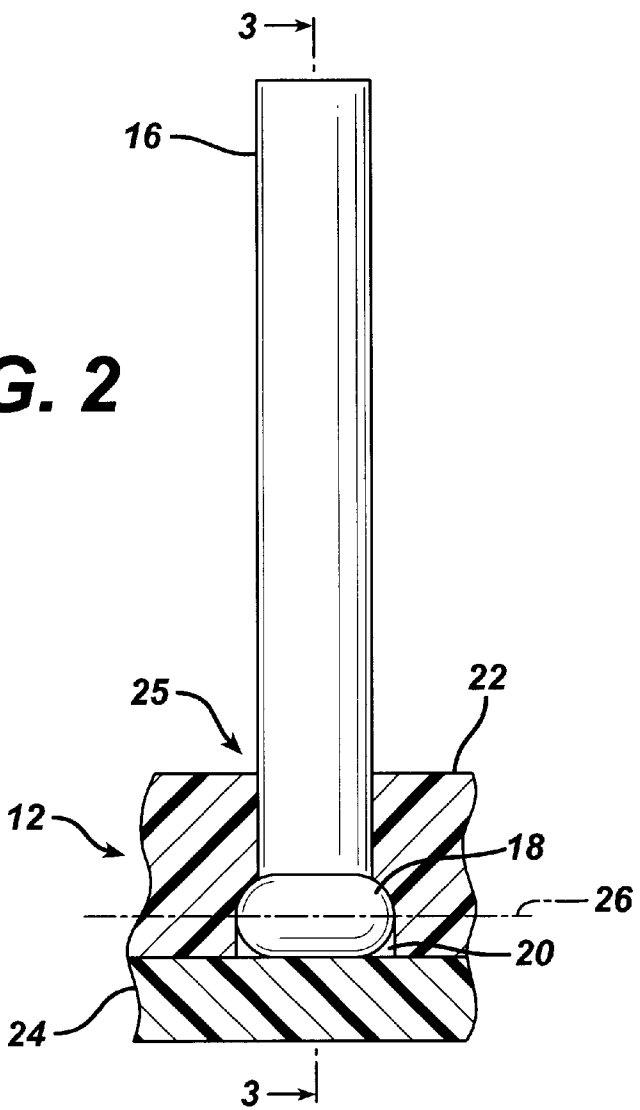
FIG. 2 is a partial sectional view of the head of the toothbrush of FIG. 1 and one of the tooth cleaning elements.

With reference to FIGS. 2 and 3, the structure for enabling element 16 to rotate and its methods of manufacture will be described. Element 16 includes at its lower end a unitary bearing 18 which is cylindrical in shape and rounded at its ends. Bearing 18 can be formed by either melting some of the material from which element 16 is made, or by molding the bearing in a separate molding operation.

Such a molding operation would use a high flow material such as Exxon Escorene Polypropylene PP-1105, or FINA Polypropylene 3824. It is important to gate from both sides and to have very low pack pressure during the molding operation. An undercut on element 16 is preferable in order to secure bearing 18 to element 16. If bearing 18 is molded separately and then secured to element 16, an adhesive can be used in place of the undercut to secure element 16 and bearing 18 together.

An example of a specific molding operation would be to use a 90 Ton Toshiba Injection Molding Machine to mold Exxon Escorene Polypropylene PP-1105. The temperature profile is a 350 F. barrel temperature, a 350 F. rear temperature, a 405 F. front temperature and a 390 F. nozzle temperature. The mold temperature is preferably about 90 F., and a 1/16 inch nozzle should be used. Fill time is 0.25 seconds, screw forward time is 3.75 seconds, injection time is 4.00 seconds and cool time is 15 seconds. Peak hydraulic pressure is 250 psi.

Head 12 is actually made up of a top piece 22 and a bottom piece 24. Both of these pieces are created in separate molding steps with piece 22 being integrally molded with the brush handle. Element 16 is inserted through an aperture 25 in top piece 22 bearing end last to the position shown in the figures. Aperture 25 includes a bearing socket 20 which captures bearing 18. It is preferable to insert a viscous substance, such as some food-grade grease, into socket 20 to provide some resistance to rotation of element 16 to prevent the element from loosely flopping back and forth. Finally, piece 24 is fixed to piece 22 to secure bearing 18 in socket 20. Piece 24 can be secured to piece 22 by, for example, snap features (not shown) or heat welding. Alternatively, piece 24 can be injection molded into place.

An alternative manufacturing method to using two pieces 22, 24 for the head is to injection mold the entire head (and handle) about bearing 18. A higher melting temperature material would need to be used for element 16 and bearing 18 so that they are not softened/melted during injection molding of the head/handle. Element 16 can be exercised after completion of the brush by rotating the element back and forth to free it in the event some plastic from the head is interfering with rotation.

The arrangement described above allows element 16 to rotate back and forth about only one axis 26 which is preferably substantially perpendicular to a long axis of element i6. Preferably, element 16 can rotate about 30 degrees either side of vertical. The top of aperture 25 limits the amount of rotation that can be experienced by element 16. It should be noted that there is no spring force or other force which returns element 16 to a home position, so the element can end up at any one of an infinite number of positions along its 60 degree freedom of movement at the end of the brushing process.

Alternatively, bearing 18 could be made in a spherical shape. Use of such a spherical bearing would still only allow element 16 to rotate about only one axis because, as shown in FIG. 2, head 12 fits up against opposite sides of element 16, thereby restricting rotation to occurring about one axis only.

Figure 4:
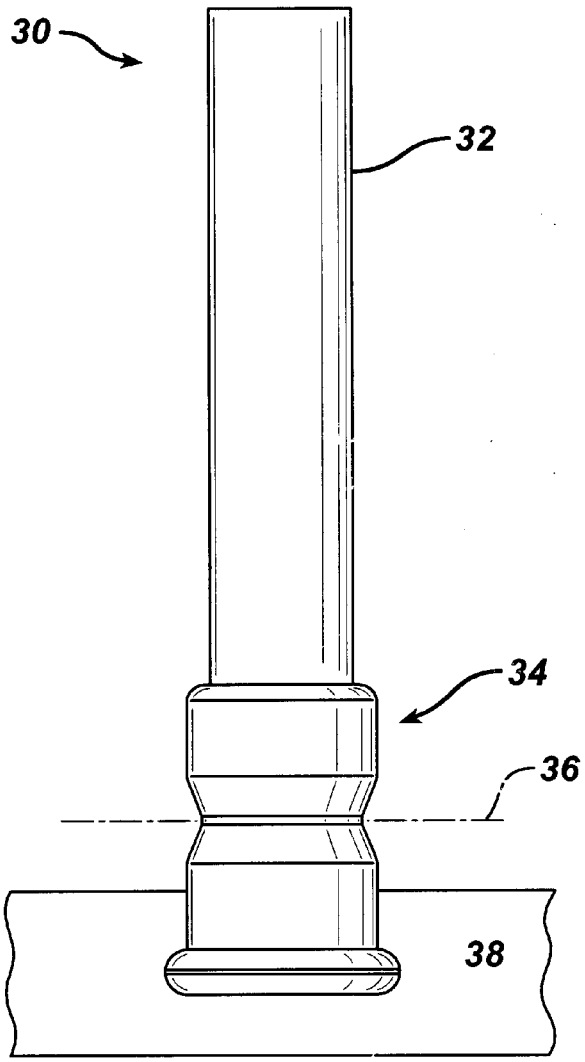
FIG. 4 is a front view of an alternative tooth cleaning element.
Figure 5:
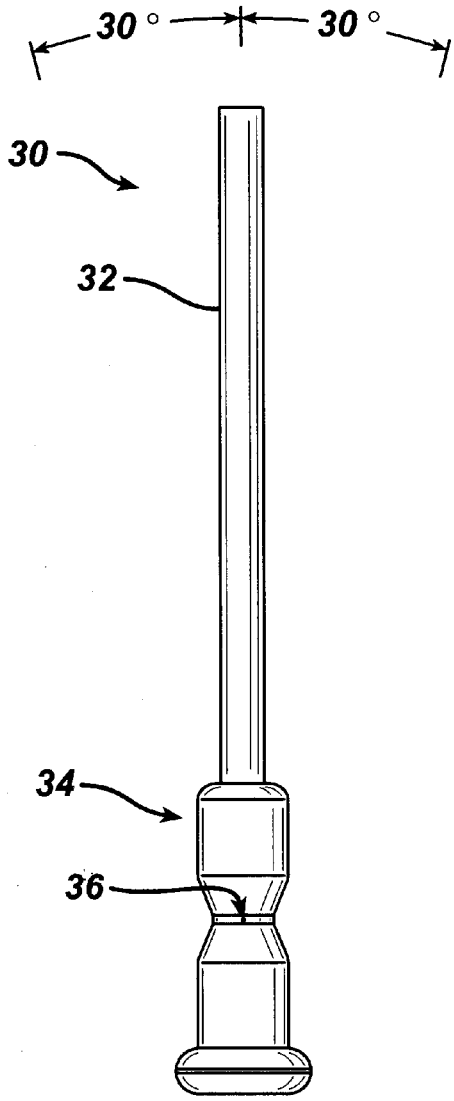
FIG. 5 is a side view of the tooth cleaning element of FIG. 4.

Turning to FIGS. 4 and 5, an alternative tooth cleaning element will be described. Element 30 includes a tooth cleaning portion 32 which can be a tuft of bristles or a unitary plastic or rubber fin. A hinge 34 (e.g. a living hinge) made of a soft plastic or elastomer is injection molded onto cleaning portion 32. The material from which hinge 34 is made must be carefully selected, because if it is too soft, retention of element 16 will be poor, and if the material is too hard, the hinge will not be flexible enough. The hinge is preferably made of GLS Corp.'s DYNAFLEX thermoplastic rubber compound G2780 or G2711 and can be injection molded under the conditions outlined above. The living hinge allows cleaning portion 32 to rotate primarily only about an axis 36 which, as described above, is preferably substantially perpendicular to a long axis of portion 32. Resistance to rotation increases as portion 32 is moved away from a position vertical to the top surface of the brush head. A toothbrush head 38 with integral handle (not shown) is injection molded about a base portion of living hinge 34 to capture the living hinge in the head (see FIG. 4).

The invention has been described with reference to a preferred embodiment. However, it will be appreciated that variations and modifications can be effected by a person of ordinary skill in the art without departing from the scope of the invention.

What is claimed is:

1. A toothbrush, comprising;

a handle;

a head extending from the handle; and a plurality of tufts of bristles extending from the head, each tuft of bristles being supported for rotation about only one axis, each tuft of bristles being rotatable independent of the other tuft(s) of bristles.

2. The toothbrush of claim 1, wherein each tuft has a range of rotation of about 60 degrees.

3. The toothbrush of claim 1, wherein each tuft can rotate about 30 degrees to either side of a vertical position in which the tuft is perpendicular to a top surface of the head.

4. The toothbrush of claim 1, further including at least one tooth cleaning element which cannot be rotated.

5. The toothbrush of claim 1, wherein each tuft includes at its non-brushing end a bearing which is substantially cylindrical in shape in its major portion, each bearing being secured in its own hollow space within the head, each bearing allowing rotation of its respective tuft.

6. The toothbrush of claim 5, wherein the head is made of at least two pieces which are joined together to secure the bearing within the head.

7. The toothbrush of claim 5, wherein a viscous substance is provided in each hollow space in the head to provide some resistance to rotation of the tufts.

8. The toothbrush of claim 1, wherein a portion of the head limits rotation of each tuft.

9. The toothbrush of claim 1, wherein the tufts are rotated by contact with a portion of an oral cavity.

10. The toothbrush of claim 1, wherein each tuft includes at its non-brushing end a living hinge, each living hinge being secured partially within the head, each living hinge allowing rotation of its respective tuft.

11. The toothbrush of claim 1, wherein the axis about which each tuft is rotatable is substantially perpendicular to a long axis of the element.

* * * * *